United States Patent [19]

Pauliukonis

[11] 3,940,937

[45] Mar. 2, 1976

[54] INTENSIFIER

[76] Inventor: Richard S. Pauliukonis, 6660 Greenbriar Drive, Cleveland, Ohio 44130

[22] Filed: Jan. 18, 1974

[21] Appl. No.: 434,568

Related U.S. Application Data

[63] Continuation-in-part of Ser. No. 244,019, April 14, 1972, Pat. No. 3,815,481.

[52] U.S. Cl. ..... 60/533; 60/411

[51] Int. Cl. ..... F15b 7/00

[58] Field of Search ..... 60/547, 533; 92/130

[56] References Cited

UNITED STATES PATENTS

| | | | |
|---|---|---|---|
| 1,037,031 | 8/1912 | Martin | 60/547 |
| 3,500,725 | 3/1970 | Haddock, Jr. | 92/130 |

*Primary Examiner*—Martin P. Schwadron
*Assistant Examiner*—H. Burks, Sr.

[57] ABSTRACT

An intensifier for use with pressurized fluids requiring additional pressure boosting to assume higher presures includes an elongated housing with differential diameter internal bore of which large end is closed by a cap with fluid port therein and the opposite small end provided with an end wall having fluid passage therethrough, a differential diameter elongated piston of close sliding fit inside the bore having small plugging piston end at one end and a large actuating piston end at the other end with an intermediate diameter intensification piston therebetween and capable of being shuttled inside housing bore from first small piston end engaged position preventing pressurized fluid supply to the intensification chamber to the second small piston disengaged position allowing fluid supply thereto while simultaneously developing an evacuated annulus inside intensifier with a vacuum force tending to maintain piston in the first position and aiding in the operation of intensifier through an airless void when actuating piston becomes pressurized urging intensification of the pressure during piston return to the first position with mechanical advantage proportional to the diametral differences of large actuating and intermediate intensifying pistons and their respective areas exposed to system pressures, with resultant displacement of fluids at elevated pressures.

6 Claims, 2 Drawing Figures

INTENSIFIER

This is a continuation in part of my copending application Ser. No. 244,019 filed Apr. 14, 1972 and now U.S. Pat. No. 3,815,481.

This invention is particularly suitable for use with Cryogenic Transfer Systems which require intensification of fluid pressures when transferred from storage dewars to high pressure compressed gas bottles, but not limited to it. Most intensifiers either employ springs to aid in the position change of the piston or springs with air vent for displacement of air during piston shuttling inside the housing.

The use of springs is associated with many disadvantages, the foremost being the energy loss while working against the spring force. In cryogenic environment, no springs can perform properly because of temperature effect to the material composition and transformation of crystals under severe temperature variations with drastic consequences to the performance of such springs: metallurgical phase changes induced by drastic temperature changes lead to premature spring failures. More critical is the air vent in equipment contemplated for use with liquefied gases at cryogenic temperatures, because of moisture segregation from the air accumulating inside such openings and depositing as ice:cold surfaces of such equipment act as a pump for air because of such removal of moisture therefrom, resulting in equipment failure due to accumulation of ice.

Intensifiers are also employed in pneumatic/hydraulic circuits, and they are quite complicated, let alone costly.

The object of this invention is to provide a simplified design of an intensifier that is suitable for applications presently plagued with difficulties, through the use of principle of evacuated space that enable piston return to the original position and provide energy savings.

Further object of this invention is to provide an intensifier that employs no springs nor any air vents, and as such is ideally suitable for cryogenic applications as well.

Devices of this type which require fewer components and improve ultimate performance of the system are obviously desirable because they provide a simple, inexpensive and reliable means of displacing fluids at higher pressure with extreme reliability at less cost initially and in service.

Other objects reside in novel details of construction and combination and/or arrangement of parts, all of which will be apparent from the description that follows.

Figure 1:
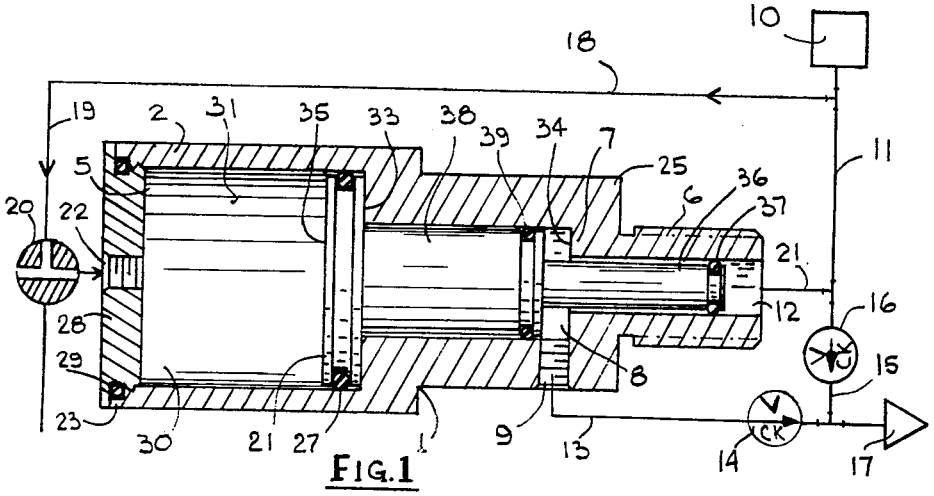
FIG. 1 is a cross-sectional view of an intensifier operated by a three-way valve in a normally closed condition with small piston inside fluid supply opening.

As can be seen from the drawngs, an intensifier 1 which is adapted to elevate the pressure of fluid leaving a source such as indicated at 10 through conduits 11 and 41 to enter inlet opening 12 at one housing end which is small for pressurization by intensifier with subsequent exhaust therefrom via port 9 through conduit 13 provided with a directional check valve 14 and interconnected with a conduit 15 also having a check valve 16 to feed a receiver through a conduit indicated diagrammatically at 17 shown in FIG. 1, and at the other housing end which is large the source 10 supplies pressurized working fluid through conduits 18 and 19 to a three-way valve 20 at the large housing end 23 feeding large actuating piston end 21 of differential diameter piston 35 via port 22.

Assuming initially that the source of pressurized working fluid is operative and the valve 20 is in open position, the piston end 21 having largest surface area is subjected to the pressure force forcing the piston 35 to assume position as shown in FIG. 1 identifying first position of intensifier with inlet opening 12 plugged.

Figure 2:
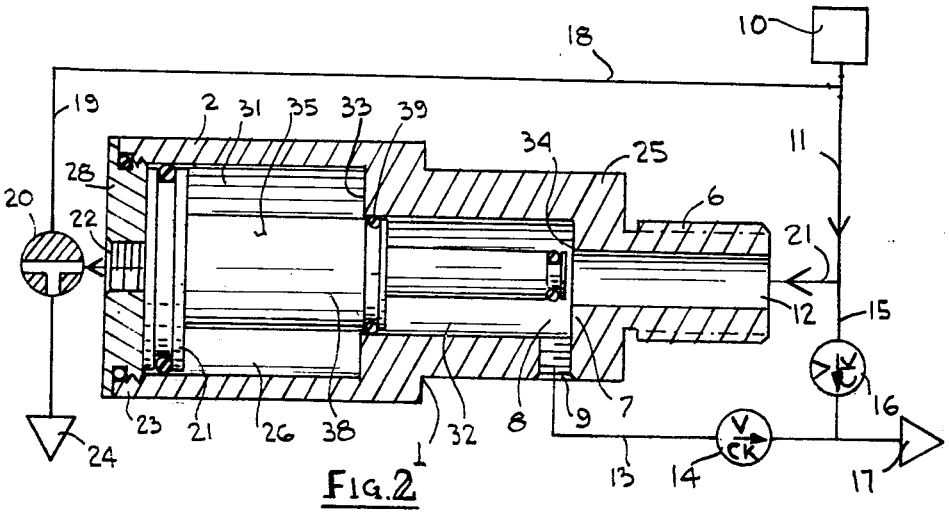
FIG. 2 is a cross sectional view of intensifier shown in FIG. 1 in its open position with large piston exhausting while small piston unplugged and the annulus formed between intermediate piston diameter and large cylinder under vacuum.

When the three-way valve 20 is shifted to a closed position, the working fluid from the large housing end 23 is allowed to escape through a conduit indicated diagrammatically at 24 as shown in FIG. 2, and the source pressure becomes predominent in the opening 12 of the small housing end 25 forcing the piston 35 to assume position shown in FIG. 2 identifying second position of intensifier with inlet opening unplugged supplying cavity 8 with the fluid while simultaneously creating an evacuated annulus 26 formed between a portion 38 of piston 35 and large housing end bore 31.

Turning to a description of intensifier 1 in more detail it is seen to include an elongated cylindrical housing 2 of which one larger diameter end 23 has an open end 5 closed by an end cap 28 with seal 29 including a fluid port 22, and the other smaller diameter end 25 provided with an end wall 7 having fluid inlet opening 12 passing therethrough centrally and incorporating a male threaded connection 6 externally, icluding an axially extending differential diameter cylindrical bore 30 therein. Bore 30 at the large diameter housing end 23 has first large diameter portion 31 continuing inwardly partway and a coaxial intermediate diameter second bore portion 32 interconnectd at innermost ends with the larger diameter portion 31 through a shoulder 33 at one end and at the other end with the coaxially extending fluid passage 12 comprising a small bore portion separated by a shoulder 34 adjacent which a fluid exhaust port 9 is located, allowing escape of pressure intensifier fluid from the cavity 8 through the side port 9 when intensifier is actuated as shown in FIG. 1.

A differential diameter coaxial piston 35 of close sliding fit with the differential diameter bore 30 has an enlarged piston end 21 with a seal 27 serving as intensifier actuating diameter at one piston end 21, also called actuator piston 21 and an elongated small diameter opposite piston end 36 with a seal 37 serving as fluid plug when piston is in position shown in FIG. 1 including an intermediate diameter piston portion 38 with a seal 39 serving as intensifying diameter also called intensifier piston 28.

The intensifier operation is dependent on the position piston 35 is forced to assume inside the bore 30, such position controllable by a single component, the three-way valve 20 which when opened to exhaust would permit intensifier feeding via opening 12 at lower pressure along with having other lines and receiver to be filled with lower pressure fluid from the source, as shown in FIG. 2. When the three-way valve is shifted to stop exhausting and to open fluid supply to the piston end 21 inside large intensifier end 23 via conduits 18, 19 and the port 22, the piston end 21 having considerably larger surface area than the other piston areas exposed to the same fluid is forced to move forward by initially plugging fluid supply passage 12 and subsequently by raising pressure inside annular cavity 8 formed between the small elongated portion of piston 36 and that of the second bore portion 32 with a force proportional to the diametral area differences of the intensifier piston 38 and actuator piston end 21 until the pistob 35 is stopped by the shoulder 33 inside bore portion 31. In effect, the intensification of pressure inside cavity 8 takes place immediately when the piston end 21, subjected to fluid pressure entering port 22 develop large end force to begin axial motion of piston 35 from the position shown in FIG. 2 while actual pressurization starts upon having small plugging piston seal 37 enter opening 12, between the constantly progressing seal 39 of intensifier piston 38 and the shoulder 34 while the passage 12 is completely disconnected through piston end 36 until piston 35 assumes the position shown in FIG. 1. FIG. 1 also identifies the normally prevalent position of the piston inside the housing established during the initial piston assembly therein through a forceful assembly of piston 35, with shoulder 33 in direct contact with piston large end 21, thereby displacing all air therefrom over seals and bottoming piston against shoulder 33 accurately, as shown in FIG. 1. When piston 35 is forced to assume a position as that shown in FIG. 2, an evacuated annulus 36 formed between piston portion 38 and bore portion 31 provides an airless void with vacuum force tending to keep piston in position shown in FIG. 1.

What is claimed is:

1. A pressure intensifier comprising:

an elongated housing having first and second ends interconneced by a differential diameter bore extending therethrough, said bore having a first large size open receiver end adjacent said first end extending a substantial portion inwardly therefrom toward said second end along the axis of said bore including a first inner end wall therein, a second small size bore portion adjacent said second end extending inwardly therefrom toward said first end along the axis of said bore, a coaxial third intermediate size bore portion interconnecting the innermost ends of said first and second bores extending inwardly from said first end wall toward said second bore including a second inner wall adjacent said second bore, an end cap permanently secured in said open receiver end including a fluid port therein, said first open receiver end having a diameter larger than the diameter of said second and third bores serving as an actuating end of said intensifier, said third intermediate size bore having a diameter larger than said second small size bore but smaller then the diameter of said first open receiver end serving as a pressure intensification chamber, said second small bore having a diameter smaller than the remaining bore portions serving as a feeding end of intensifier with said small opening permitting fluid supply thereto, said housing further including a side port entering housing wall adjacent said second inner wall perpendicularly for fluid exhaust from said third size bore portion during the pressure intensification therein, a pressure intensification means for elevating pressures of the fluid entering said third size bore portion via said fluid supply opening and exiting at higher pressures via said fluid exhaust side port, said pressure intensification means movable from a first position wherein said small fluid supply opening is closed to a second position wherein said fluid supply opening is wide open, means for generating an airless evacuated annulus therein with substantial vauum force in at least one of said positions, means for shifting said pressure intensification means to move from one of said positions by the pressurized fluid force coupled with said vacuum force means efficiently and with energy conservation to another of said positions, means for maintaining said pressure intensification means in one of said positions including valving means for porting fluid to fluid operable means, said pressure intensification means further including an elongated axially slidable piston having differential diameters of corresponding close sliding fit with said differential diameter housing bore portions, with a first large diameter short portion of said piston at one end serving as an actuating end of said intensifier, a second small diameter elongated portion of said piston at the opposite end serving as a plugging piston end for fluid supply opening and a third intermediate diameter elongated portion interconnecting the innermost ends of said first and second portions of said piston serving as a pressure booster when shuttled inside said housing bore from the first small piston engaged position with said fluid supply opening closed to the second small piston disengaged position allowing fluid supply to said pressure intensification chamber when said valving means initiate said fluid operable means for porting the pressurized fluid in said actuating end of said intensifier selectively allowing fluid flow to one of said housing bore ends thereby shifting said piston between said first and second positions wherein when said valving means permit pressurization of said piston actuating end, said fluid operable means will shift said piston by fluid action over said large diameter piston end to said first small piston engaged position, and wherein said valving means permit depressurization of said piston actuating end by allowing escape of the pressurized fluid out of said actuating housing end, said fluid operable means will shift said piston by fluid action ove said small diameter piston end to said second small piston disengaged position while simultaneously generating said evacuated annulus formed between said third portion of said piston and said first large size bore portion when said piston is in said second small piston disengaged position, the return of said piston to said first small piston engaged position by fluid action over said large diameter piston end accompanied by the vacuum force in said evacuated annulus substantially aiding in the operation of said intensifier when fluid trapped inside said intensification chamber is subjected to the force said pressure booster exerts over said fluid, said force being proportional to the diametral differences of said first large actuating and said third intermediate diameters of said piston and capable of having pressure elevation inside said intensification chamber forcing fluid to exit via said side port therefrom at substantial pressure boost induced thereto by the same pressurized fluid action over said piston surfaces entailing mechanical advantage therein.

2. A pressure intensifier as in claim 1 wherein said piston includes seals inside peripheral grooves provided therein.

3. A pressure intensifier as in claim 1 wherein said valving means for porting fluid includes a three-way directional valve disposed generally at said actuating end of said intensifier.

4. A pressure intensifier as in claim 3 wherein said valving means further includes a directional check valve disposed in said side port of said housing to prevent return of fluid discharged at elevated pressures during said change of positions piston assumes therein.

5. A pressure intensifier as in claim 4 wherein said valving means includes a second directional check valve in a conduit feeding intensifier said second end when interconnected with a conduit leaving said directional valve in said side port disposed so as to prevent high pressure fluid back flow when dispensed from intensifier to flow to a receiver at boosted pressures.

6. A pressure intensifier as in claim 1 wherein said housing first inner end wall having a shoulder defined between differential diameter portions, said piston having a shoulder defined between said first and said third diameter portions, including seals on said differential diameters of said piston, said piston in said first small piston engaged position being positioned within said housing bore with said respective shoulders of said piston and said end wall abutting and bottoming one another displacing air therefrom to render evacuated space between said housing end wall and said first large diameter piston forming an annulus between said first large diameter housing portion and said elongated portion of said third diameter portion when said piston is moved to the second piston disengaged position whereby upon removing pressure from said supply opeing, said piston is returned to a first small piston engaged position by the force of the vacuum even without pressurization of said piston actuation end, tending to maintain said piston in said first position after initial assembly of said piston inside said housing bottomed.

* * * * *